United States Patent [19]

Kennepohl et al.

[11] 4,155,654

[45] May 22, 1979

[54] APPARATUS FOR CONTINUOUS PREPARATION OF SULFUR ASPHALT BINDERS AND PAVING COMPOSITIONS

[75] Inventors: Gerhard J. A. Kennepohl; Alan Logan; David C. Bean, all of Oakville, Canada

[73] Assignee: Gulf Canada Limited, Toronto, Canada

[21] Appl. No.: 916,672

[22] Filed: Jul. 28, 1978

Related U.S. Application Data

[62] Division of Ser. No. 530,919, Dec. 9, 1974.

[51] Int. Cl.[2] ..... B28C 7/12

[52] U.S. Cl. ..... 366/16; 366/23; 366/24; 366/144; 366/146; 366/161

[58] Field of Search ..... 366/22, 16, 17, 21, 366/23, 24, 145, 144, 146, 148, 149, 152, 160, 161, 8; 106/274; 137/87

[56] References Cited

U.S. PATENT DOCUMENTS

| | | | |
|---|---|---|---|
| 480,235 | 8/1892 | Dubbs | 106/274 |
| 2,354,634 | 7/1944 | Griswold | 366/21 |
| 3,463,461 | 8/1969 | Kirk | 366/17 |
| 3,857,552 | 12/1974 | Ohlson | 366/23 |
| 3,970,468 | 7/1976 | Garrigues | 106/274 |

*Primary Examiner*—Robert W. Jenkins
*Attorney, Agent, or Firm*—D. R. Morrison

[57] ABSTRACT

Apparatus is disclosed for continuous preparation of a blend of liquid sulfur in fluid asphalt in specified proportions to provide a dispersion of fine sulfur droplets in the asphalt, particularly suitable for coating onto aggregate to form "hot mix" for asphalt concrete of improved strength.

11 Claims, 1 Drawing Figure

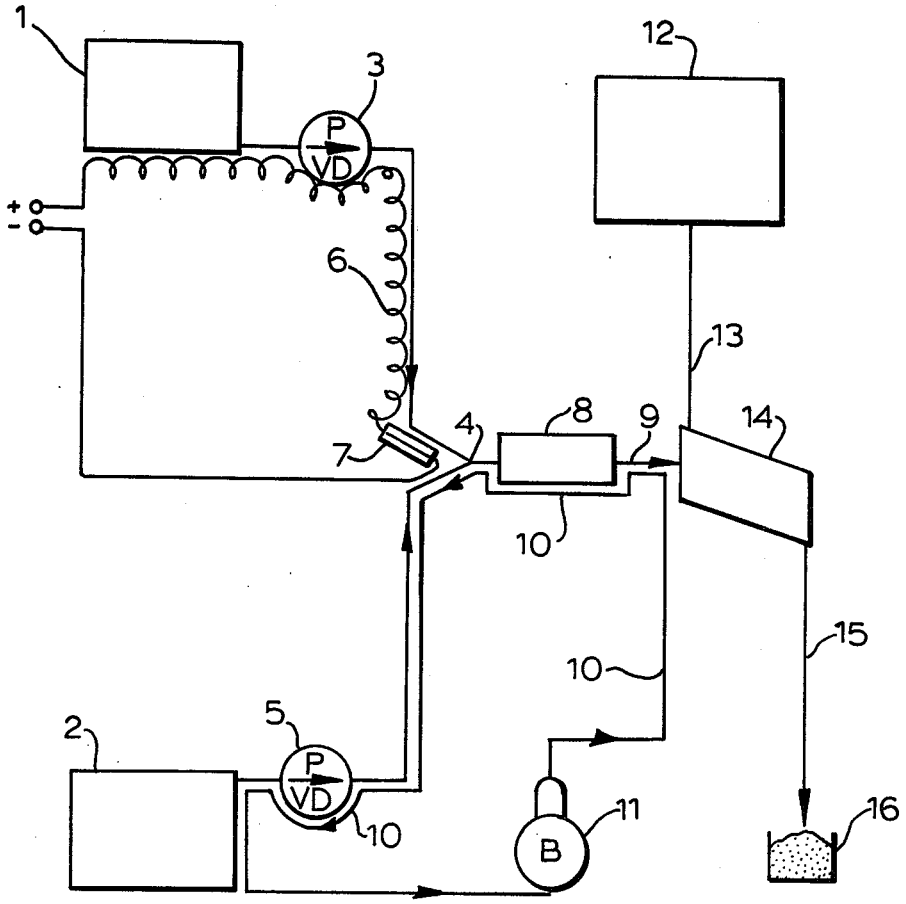
1
3
P
VD
12
+
-
6
13
4
8
9
14
7
10
15
10
2
5
P
VD
10
11
B
16

APPARATUS FOR CONTINUOUS PREPARATION OF SULFUR ASPHALT BINDERS AND PAVING COMPOSITIONS

This application is a division of our prior application Ser. No. 530,919 filed, Dec. 9, 1974. The present invention relates to apparatus for the preparation of fluid compositions of molten sulfur and asphalt and compositions of particulate aggregate coated with the fluid sulfur and asphalt compositions. More particularly the invention relates to equipment for preparing aggregates coated with particular mixtures of molten sulfur and asphalt suitable for example for spreading and compacting to form a road or to renew the surface of a road.

It is well practised procedure to coat aggregate material, for example sand, gravel, crushed stone, or mixtures of the foregoing, with hot fluid asphalt, spread the coated material as a uniform layer on a road bed or previously built road while it is still hot, and compact the uniform layer by rolling with heavy rollers to form a smooth surfaced road or base course. Thousands of miles of roads in North America and elsewhere have been built or maintained using this general procedure, and millions of dollars are invested in equipment for carrying it out. An essential requirement for the procedure has been an adequate and economic supply of paving grades of asphalt, which is mixed in proportions of between about 5 and about 12% by weight of the coated aggregate. However, with the growing world shortage of petroleum products and the increasing demand for use of heavy petroleum fractions as fuel, it becomes expedient to find a way to extend the amount of paving asphalt that can be obtained from available petroleum.

It has long been known that sulfur can be mixed with asphalt in wide ranges of proportions for various purposes. However, numerous and varied difficulties have been encountered in utilizing such mixtures in road building and, despite the now obvious need, it appears that no suitable equipment has previously been devised to meet the needs of the road building and road paving industry for sulfur/asphalt bound aggregate. For example, Canadian Pat. No. 755,999 issued Apr. 4, 1967 to Charles T. Metcalf suggests a paving composition of particulate aggregate with the void spaces between the aggregate particles being completely filled with a sulfur/asphalt mixture containing at least 50% (and up to 80%) sulfur and the sulfur being present in the mix as a discontinuous separate phase which acts as a filler between aggregate particles. Other literature, referred to in the foregoing patent for example, describes various other sulfur/asphalt paving compositions, none of which appear to have found any acceptance by the road building and paving industry; these prior art compositions have included sulfur/asphalt reaction products, sulfur/asphalt mixtures in which the sulfur is preplactized with one or more complex compounds before mixing with the asphalt, and compositions in which the proportion of sulfur is so small as to have no significant effect in extending or replacing asphalt in the composition.

It has now been found that sulfur/asphalt mixtures, having from substantially 25 to substantially 60 parts of sulfur per 75 to 40 parts of asphalt, when appropriately mixed with each other and then with appropriately sized particulate aggregate, provide a paving composition which can be applied for example to form a base course or surface course for paved areas such as roads, airport runways, and parking lots, using conventional asphalt road paving equipment. The proportions and percentages referred to throughout this specification and the appended claims are proportions and percentages by weight unless otherwise specifically noted herein.

The invention thus consists in apparatus for preparing a fluid sulfur asphalt composition comprising (1) pumping means to supply a continuous metered stream of molten sulfur, (2) pumping means to supply a continuous metered stream of fluid asphalt, (3) blending means to blend said streams continuously in proportions of 25 to 60 parts of sulfur per 75 to 40 parts of asphalt and thoroughly mix them to emulsify liquid sulfur, which does not combine homogeneously with the asphalt in the blended stream, as droplets in the size range from one to fifty microns, and (4) temperature regulating means to maintain said stream of molten sulfur in the range from 250° to 310° F. (121° to 154° C.), said stream of fluid asphalt in the range from 250° to 350° F. (121° to 177° C.), and said blended stream in the range from 250° to 310° F. (121° to 154° C.).

The invention still further consists in apparatus for preparing a coated particulate aggregate paving composition, comprising (1) pumping means to supply a continuous metered stream of molten sulfur, (2) pumping means to supply a continuous metered stream of fluid asphalt, (3) blending means to blend said streams continuously in proportions of 25 to 60 parts of sulfur per 75 to 40 parts of asphalt and thoroughly mix them to emulsify liquid sulfur, which does not combine homogeneously with the asphalt in the blended stream, as droplets in the size range from one to fifty microns, (4) temperature regulating means to maintain said stream of molten sulfur in the range from 250° to 310° F. (121° to 154° C.), said stream of fluid asphalt in the range from 250° to 350° F. (121° to 177° C.), and said blended stream in the range from 250° to 310° F. (121° to 154° C.), and (5) mixing means, at the discharge of said blending means, for mixing said metered blended stream with a metered quantity of particulate aggregate having a temperature no greater than 310° F. (154° C.) to coat said aggregate uniformly with the blended stream. From the mixing means, discharging the conveying means, as are conventional in the utilization of asphalt coated aggregate, can transfer the resulting "hot mix" to a point of application before it cools to a temperature at which it cannot be compacted. The invention is illustrated schematically in the FIGURE of the accompanying drawing, showing one combination of elements suitable to constitute the invention. In the FIGURE, 1 and 2 represent storage tanks for liquid sulfur and fluid asphalt respectively. Liquid sulfur can be withdrawn from tank 1 by a variable delivery pump 3 and pumped at a measured desired rate to Y connection 4. Fluid asphalt can be withdrawn from tank 2 by another variable delivery pump 5 which pumps it to Y connection 4 also at a measured rate which is proportioned to that of the sulfur. The sulfur storage, pump, and pumping lines, as shown, are fitted with an electric heating element 6 controlled by thermostat 7, which maintains the temperature of the sulfur at any desired value in the range from 250° to 310° F. (121° to 154° C.). A similar electrical heating element (not shown) might also be fitted to the asphalt storage, pump, and pumping lines, in place of the alternative means illustrated. Molten sulfur and fluid asphalt are delivered by the Y connection to a high shear type mixer 8, in which the molten sulfur is dispersed in the fluid asphalt; with proportions of 25 to 60 parts of sulfur per 75 to 40 parts of asphalt, a high shear mixer emulsifies sulfur in the asphalt as droplets in the size range from 1 to 50 microns. The resulting dispersion of sulfur in asphalt flows from the discharge line 9. The asphalt storage, pump, and pumping lines and also the mixer and dispersion discharge lines, in the invention embodiment shown in the drawing, are fitted with tracing lines 10 which circulate hot oil from and to boiler 11; temperature of the oil circulating in the lines 10 regulates the temperature of the fluid asphalt fed to mixer 8 and of the sulfur/asphalt composition flowing from discharge line 9. Also in the embodiment shown, a supply of aggregate in stockpile 12 is connected by an appropriate aggregate preparation line 13 to a continuous pug mill 14. Along the line 13 aggregate ingredients in the desired proportions of various screen size material can be heated and dried conventionally, e.g. by an oil-fired drum dryer which heats the aggregate, after which it is metered into pug mill 14 at temperature no greater than 310° F. (154° C.), the rate of metering the aggregate and sulfur and asphalt pumping rates being adjustable relative to one another. The pug mill mixes the aggregate with sulfur/asphalt dispersion and coats the dispersion on the aggregate as a thin film to form "hot mix". The "hot mix" product is stable and is conveyed through discharge 15 to transportation facility 16 which transports it to a point of application before it cools to a temperature at which it cannot be compacted.

The proportions of sulfur to asphalt in the compositions of the invention are obviously of extreme importance, inasmuch as the sulfur acts not only to extend the asphalt in the compositions, thereby reducing the proportion of asphalt conventionally required in relation to the aggregate, (for which reason it may be desirable economically to use as high a proportion of sulfur as possible) but the sulfur also affects the physical properties of the asphalt with which it is mixed in this invention, making the proportions critical in relation to the other critical limitations in the invention. Thus proportions of sulfur significantly below substantially 25% by weight of the binder are inadequate because they provide insufficient sulfur in the form of liquid droplets in the binder to achieve the advantages of the invention. Likewise proportions of sulfur significantly above substantially 60% by weight of the binder are unsuitable because sulfur in excess of this proportion tends to coalesce rather than remaining dispersed as fine liquid sulfur droplets; the higher proportions may even cause phase inversion so that the dispersion becomes one of asphalt in sulfur rather than sulfur in asphalt, thereby completely upsetting the anticipated binding characteristics of the binder. The preferred proportions of sulfur and asphalt are from 35 to 50 parts of sulfur per 65 to 50 parts of asphalt, on the basis of current relative cost of the ingredients and the optimum of desired physical properties of the paving or other composition to be bound therewith. Typical physical properties of blends of a typical 85–100 penetration (Pen) paving asphalt and specified proportions of molten sulfur, for use in accordance with this invention, are listed in the following table by way of example:

| COMPONENTS | BLEND COMPOSITION - (WEIGHT %) | | | | | |
|---|---|---|---|---|---|---|
| 85–100 Pen Asphalt | 100 | 70 | 60 | 55 | 50 | 40 |
| Sulfur | 0 | 30 | 40 | 45 | 50 | 60 |
| Gravity, Specific, 60° F. | 1.0268 | 1.1828 | 1.2320 | 1.2854 | 1.3442 | 1.4337 |
| Softening Point, °F. (ASTM D36) | 112 | 107 | 108 | 109 | 111 | 134 |
| Penetration, 77° F. 100 g. 5 sec. (ASTM D5) | 92 | 181 | 183 | 168 | 70 | 72 |
| Ductility, 77° F. (ASTM D92) | 150+ | 29 | 25 | 47 | 44 | 23 |
| Flash Point, COC, °F., (ASTM D92) | 560 | 345 | 335 | 330 | 320 | 325 |
| Fraas Break Point, °C., (IP 80) | −16 | −12 | −13 | −14 | — | — |

With reference to relevant temperatures with respect to the invention, it must be appreciated that many reactions between sulfur and asphalt can occur, varying among other things with the temperature at which the sulfur and asphalt are in contact. Chemical reactions between sulfur and asphalt which evolve hydrogen sulfide do not occur to any serious extent at temperatures below substantially 300° F. (149° C.). It is thus essential, in order to avoid the dangers of evolution of hydrogen sulfide with the present invention and in using the invention in the paving of roads, to restrict the temperature of mixtures of sulfur and asphalt to a range below substantially 310° F. (154° C.), and to restrict the temperature of aggregate onto which the sulfur/asphalt binder mixtures are coated to a range below substantially 310° F. (154° C.). These temperature limitations are relevant not only to the avoidance of hydrogen sulfide generation, but also to economy of fuel and the practicality of compacting coated aggregate after it has been spread on a road or other base. In conventional asphalt aggregate plants, the aggregate to be coated with asphalt is usually heated to a temperature around 350° F. (177° C.) to make the material hot enough to keep the asphalt that is coated thereon soft until such time as the material has been spread on a road or other base and compacted. With the present invention, the aggregate must not be used at a temperature above about 310° F. (154° C.) for reasons indicated above, thereby permitting considerable economy in fuel required to heat the large tonnages of aggregate that are used. Additionally, even though the coated aggregate may be spread and compacted at temperatures significantly lower than are used when spreading and compacting conventional asphalt coated aggregate, for example from 20° to 50° F. (11° to 28° C.) lower, sulfur/asphalt coated aggregate prepared by the present invention is readily and easily utilized with conventional asphalt road building equipment used in the conventional way, as the sulfur/asphalt binder remains fluid at such lower temperatures, and thus aggregates coated therewith can be spread and compacted at these temperatures with no modification of the road building equipment.

The molten sulfur/asphalt binder produced by this invention is a critical ingredient whose preparation and application onto aggregate are completed in as brief a time as possible, allowing no more than a maximum time of substantially 1 hour, preferably less than 15 minutes, to lapse between the initial blending of molten sulfur and asphalt ingredients and the application of the mixture onto aggregate, more preferably less than 5 minutes and most preferably less than 1 minute. Thus, in accordance with the most preferred form of the invention, in a matter of a few seconds molten sulfur and fluid asphalt in the proportions and temperature ranges previously indicated therefor are blended and vigorously mixed to permit both (a) the almost instantaneous reaction that occurs between the asphalt and a considerable part of the sulfur in the indicated temperature range and (b) the dispersion of the balance of the molten sulfur as droplets of liquid sulfur in the size range from 1 to 50 microns; within the ensuing few seconds the resulting mixture is coated onto aggregate at temperature no greater than the previously indicated maximum of substantially 310° F. (154° C.). The resulting coated aggregate can then be applied at the point of utilization by spreading and compacting any time within the time taken by the coated aggregate to cool to the minimum compaction temperature.

It is critical also that, when blended together in the molten state and in the proportions already indicated, the sulfur and asphalt be mixed vigorously so that the sulfur is rapidly, finely, and evenly dispersed into the asphalt, thereby permitting the rapid solution in and reaction of a large part of the sulfur in the asphalt and the uniform, intimate emulsification of the balance of the sulfur in the asphalt matrix; the mixing must be vigorous enough to ensure subdivision of the liquid sulfur into droplets of a size in the range from 1 to 50 microns, preferably 1 to 10 microns.

It will be apparent that in utilizing the invention, it is most conveniently utilized entirely in a continuous manner with continuous flows of ingredients through the various steps or stages from beginning to the end. However, it is possible and frequently convenient or necessary to utilize some batch operations, thereby requiring some intermittent or semi-continuous operation in other stages and/or inter-stage accumulation of ingredients to form batches. Thus in the final stage of such utilization, coated aggregate conventionally is conveyed to its point of application, which may be many miles from the point of preparation, in truckloads each of which contains an accumulated batch discharged from a continuously operating aggregate coating stage. Likewise the coating stage may be a batch mixing operation utilizing for example a batch pug mill into which a batch of aggregate is weighed from a supply of stored aggregate and also into which a metered quantity of sulfur/asphalt binder is passed, either as all or part of a stream discharging continuously from a continuous sulfur/asphalt mixing stage, or as a stream discharging intermittently from a sulfur/asphalt mixing stage. Because of the relatively viscous nature of the ingredients and the vigorous agitation which is required to emulsify sulfur droplets in asphalt, it is highly desirable that the blending and/or mixing of the sulfur and asphalt be carried out with simultaneous continuous addition of these two ingredients to the mixing operation, simultaneous continuous withdrawal of resulting sulfur/asphalt from the mixing operation, and with minimum accumulation of ingredients in the mixing stage, thus minimizing the amount of back-mixing that can occur and facilitating the formation of uniform binder.

In apparatus in accordance with this invention, pumping means of types suitable for pumping fluid asphalt, which are well known in the art, are suitable also as the pumping means to pump molten sulfur for the invention. The temperature regulating means to maintain the streams of sulfur and asphalt in the required temperature ranges conveniently comprise, for example, thermostatically controlled electric heating elements or steam tracing or tracing lines circulating hot oil, to compensate for the heat lost during transfer of the materials from storage to mixing of the ingredients. The blending and mixing means can include the ordinary industrial homogenizers, blenders, colloid mills, or other mixers capable of creating high shear in fluid asphalt and of operating at the elevated temperature required to disperse molten sulfur into fluid asphalt. Preferred of course are the types in which continuous streams of molten sulfur and of asphalt are rapidly belended and mixed during concurrent flow through a small mixing zone with no recycling or back mixing of the resultant sulfur/asphalt binder. The mixing means for mixing the metered binder with metered or measured quantities of aggregate to coat the binder thereon can be, for example, a batch pug mill or a continuous pug mill or a continuous rotary dryer-drum type of mixer recently developed for the simultaneous continuous drying of metered aggregate and coating of the aggregate with asphalt binder to form paving mixtures. This mixing means should preferably be located in close proximity to the sulfur/asphalt mixing means so that the sulfur/asphalt binder can be coated onto aggregate soon after, preferably directly after, its formation.

Laboratory comparison of the Marshall Mix Design properties of paving mixtures having a 50:50 sulfur:asphalt binder with mixtures containing just the asphalt (85–100 Pen grade) as binder shows that the sulfur/asphalt binder provides mixtures with far greater stabilities. Typical Marshall data for specimens made with 100% 85–100 Pen asphalt binder (AC) and 50:50 sulfur/asphalt (85–100 Pen) binder (SA) are shown in the following table under columns AC and SA respectively.

MARSHALL TEST DATA

| | Air Voids (%) | | VMA* (%) | | Flow (0.01 Inch) | | Stability (lb) | |
|---|---|---|---|---|---|---|---|---|
| % Binder | AC | SA | AC | SA | AC | SA | AC | SA |
| 6.0 | 4.8 | 7.3 | 18.8 | 18.1 | 9.5 | 10 | 1811 | 3934 |
| 6.5 | 3.4 | 5.6 | 18.6 | 17.4 | 10 | 8.5 | 1833 | 4351 |
| 7.0 | 2.1 | 4.5 | 18.4 | 17.3 | 11 | 8.5 | 1398 | 4362 |
| 7.5 | 1.0 | 4.0 | 18.5 | 17.7 | 14 | 8.5 | 1224 | 4224 |

-continued

| MARSHALL TEST DATA | | | | | | | | |
|---|---|---|---|---|---|---|---|---|
| | Air Voids (%) | | VMA* (%) | | Flow (0.01 Inch) | | Stability (lb) | |
| % Binder | AC | SA | AC | SA | AC | SA | AC | SA |
| 8.0 | 0.6 | 1.4 | 19.2 | 16.2 | 15 | 9.5 | 1011 | 4209 |

*Voids Mineral Aggregate

The higher binder content required for the optimum percent air voids of the sulfur/asphalt binder is a consequence of the higher specific gravity of the binder containing elemental sulfur which has a specific gravity of about 1.96. Additional Marshall data which have been assembled in both laboratory and field determinations confirm the following observations which can be made regarding paving mixtures made with apparatus of the present invention:

1. The Marshall stabilities of test specimens are considerably higher than those of specimens made with asphalt only as the binder.
2. The Marshall stabilities of test specimens increase with increasing sulfur content within the specified range of the invention.
3. Despite the high Marshall stabilities of the test specimens containing sulfur/asphalt binder, no significant loss in flow properties at the 140° F. (60° C.) testing temperature is experienced; the flows shown in the foregoing table are within the generally accepted range.
4. Low quality aggregates, for example blow sands with little angularity and aggregates with poor gradation, can be stabilized effectively.
5. The Marshall stabilities after water soaking of test specimens are the same as those for unsoaked specimens, indicating high water resistance imparted by the sulfur/asphalt binder.
6. Paving asphalts of various penetration grades can be used to produce good sulfur/asphalt binders.

In addition to the Marshall data referred to above, additional evaluation of paving mixes containing sulfur/asphalt binder, in accordance with the invention, has shown for example that the low-temperature response of the mixes is not significantly different (i.e. within limits of testing error) from that for conventional paving mixes containing only the asphalt binder, thus the sulfur/asphalt binder has no adverse effect on the low temperature response of the mix. Likewise evaluation of the fatigue properties has shown no adverse effects due to the use of sulfur/asphalt binder in a paving composition in lieu of a binder of asphalt alone. Low temperature and fatigue properties were assessed by methods established in the art, viz: Haas, R. C. G., "Designing Asphalt Pavements to Minimize Low Temperature Shrinkage Cracking", Asphalt Institute Report RR37-1, January 1973, and Morris and Haas, "Characterization of Bituminous Mixtures for Permanent Deformation Predictions", ASTM STP Publication No. 561, 1974. Furthermore, on comparison with a 100% asphalt coating on aggregates tested, a coating of sulfur/asphalt (50:50) on the same aggregates showed a superior resistance to stripping of the coating from the aggregates after prolonged soaking in water.

The following examples are given to illustrate various facets of the invention and the advantages to be derived therefrom.

EXAMPLE 1

This example illustrates an embodiment of the invention in the preparation of an asphalt road paving composition using some portable blending equipment in conjunction with other permanently installed mixing equipment and the application of the composition as a surface coat to a previously prepared base in a quarry entrance used by the heavily loaded trucks of the quarry and stone crushing plant. The portable equipment included mobile storage capacity for molten sulfur and asphalt, the pumping means to supply continuous metered streams of molten sulfur and asphalt from said storage, the temperature regulating means to regulate these streams in the desired appropriate temperature ranges, and the blending and mixing means; all their connecting feed and discharge lines were insulated and equipped with electric resistance heating elements to provide heat and temperature control for the equipment and material being conveyed therethrough. The permanently installed mixing equipment comprised part of a long-established conventional asphalt-aggregate mixing plant and included batch weighing means for weighing batches of crushed stone and sand, separate weighing means for weighing batches of asphalt, a batch pug mill with conventional counter-rotating twin shaft unit capable of mixing 3,000 pound (1360 kg) batches of aggregate and asphalt in a controlled mixing period. Mixed batches of asphalt aggregate could be discharged directly from the mill into transport trucks by gravity. To carry out the preparation of the paving composition the sulfur and asphalt pumping means, blending and mixing means, and connecting lines were heated with the electric resistance heating elements until the equipment was at substantially 300° C.). Then the mobile sulfur and asphalt storage tanks were connected by well insulated flexible nominal 2-½ inch (6.5 cm) hose lines to separate twin "Roto-King" (trademark) positive displacement pumps (Model LQ 32), each with mechanical variable speed drive driven by 3 horsepower (2.25 K.W.), 3 phase, electric motors providing pump speeds between 38 and 190 rpm and each capable of delivering between 3 and 43 U.S. gallons per minute (11.3 and 163 liters per minute). Molten sulfur and asphalt were pumped in the desired proportions by these pumps through separate short insulated lines to a Y connection in which the molten sulfur and asphalt streams merged and flowed through a short 3-inch (8 cm) diameter connection to the inlet of a Gifford-Wood pipeline mixer (model PL5) of nominal 5 inch (13 cm) size. This mixer was coupled directly to a 20 horsepower (15 K.W.) motor operating at 3500 rpm and contained a single high-speed turbine-stator with 8 holes of 1-¼ inch (31 mm) diameter in the stator and between 0.008 and 0.012 inches (0.203–0.305 mm) clearance between the stator and rotor. In flowing through this mixer the sulfur in excess of about 20% by weight of the blend of sulfur and asphalt did not react with nor dissolve in the asphalt but was emulsified or dispersed therein as liquid sulfur droplets of less than 10 microns diameter, averaging between 1 and less than 10 microns; a proportion of the sulfur, up to about 20% by weight of the blend, reacted with or dissolved in the asphalt. From the mixer, the sulfur/asphalt mixture was conveyed through an insulated flexible line to a weighing pan in which desired quantities measured by weight were accumulated than discharged onto weighed quantities of aggregate in the pug mill. Aggregate fed to the pug mill included proportions of about 35% of ⅜ inch (10 mm) crushed stone, i.e. all pieces smaller than ½ inch (12 mm) and over 90% retained on a No. 4 U.S. Sieve series screen having 0.187 inch (4.76 mm) openings, 49% crushed stone screenings, i.e. 98% passing through 0.187 inch (4.76 mm) screen openings and 90% retained on a 200 mesh screen having 0.0029 inch (0.074 mm) openings, and 16% sand (99% passing through 0.0469 inch (1.19 mm) openings and 99% retained on a 200 mesh screen having 0.0029 inch (0.074 mm) openings). The foregoing aggregate ingredients were dried by passage through an oil fired rotary dryer which delivered the heated material to storage bins over the pug mill, from which they were weighed in batches of desired proportions into the pug mill. Quantities of aggregate having a temperature in the range 290°-300° F.) (143°-149° C.) sulfur/asphalt mixture having a temperature in the range of 290°-295° F. (143°-146° C.), after being weighed in desired proportions into the mill and mixed therein for a controlled period to coat the sulfur-/asphalt binder on the aggregate, were dumped from the mill into trucks for transport to a conventional asphalt paving machine at the nearby paving site. There the coated aggregate was spread on a previously paved base to a depth of two inches (5 cm) and rolled with a tandem roller in the conventional manner for laying and rolling asphalt paved roads. No difficulties were encountered in laying and rolling to compact this surface. The asphalt used in this example was an 85-100 Pen paving asphalt.

Typical characteristics of a paving asphalt of this grade are, for example:

Gravity, API 60° F.-6.5
Specific Gravity, 60° F.-1.0254
Viscosity, Poise, 140° F., ASTM D2171-1770
Viscosity, cs, 275° F., ASTM D2170-362.2
Flash Point, COC, °F., ASTM D92-600
Softening Point, °F., ASTM D36-114
Pen, 77° F., 100 g, 5 sec., ASTM D5-89
Ductility, 77° F., cm, ASTM D113-150+
Soluble in Trichloroethylene, ASTM D2042-99.9%

The sulfur was a commercial grade of elemental sulfur, by-product of a petroleum refinery. For the paving composition of this example the sulfur and asphalt were blended in proportions of 50:50. By conventional Marshall Mix Design tests using the foregoing aggregate and the foregoing 85-100 Pen asphalt as the only binder it was determined in the laboratory that 5.8% was the optimum proportion of this binder with this aggregate for optimum paving composition properties. Inasmuch as sulfur has a considerably higher specific gravity than asphalt and blends of sulfur/asphalt consequently also have a higher specific gravity than asphalt, it is natural that the weight proportion of sulfur/asphalt mix which is optimum as binder for the paving composition be higher than that for asphalt alone as binder, as substantially equal volumes of binder are required to completely coat equal weights of aggregate with equal thicknesses of coating. Thus the optimum weight proportion of the 50:50 sulfur/asphalt binder for the foregoing aggregate, as determined by Marshall tests, was in the range 7.0-8.0%, and a proportion of 7.7% was used in the paving composition of this example. To verify that the sulfur/asphalt binder contained the dispersed droplets of liquid sulfur of below 10 micron size only, random samples of the binder as it was being added to the aggregate were taken and examined visually under a microscope. Of particular significance in the Marshall test results was the fact that the stability determinations on the test samples showed that the optimum asphalt-aggregate proportions provided a Marshall stability of slightly under 2000, whereas the optimum sulfur/aslphalt-aggregate proportions provided a Marshall stability of over 3000, an increase of over 50%. Furthermore, despite the greater Marshall stability, indicative of greater strength in the finished surface coat after rolling and hardening of the paving composition, the sulfur/asphalt paving composition was no harder to compact while the paving composition was still hot, because of the presence of the finely divided liquid sulfur droplets in the binder; also, the hot paving composition containing the sulfur/asphalt binder could cool to a lower temperature than can normal asphalt binder mixes before becoming too hard to roll and compact effectively.

EXAMPLE 2

This example illustrates a slightly different embodiment of the invention from that of Example 1, but utilizes some of the parts thereof. In this example, the portable mixing equipment to pump and mix molten sulfur and asphalt, as described in Example 1, was transported by truck to a road paving job located about 2,400 miles (3860 km) from the site used in Example 1. At the new location it was used in collaboration with a mobile continuous asphalt-aggregate mixing unit ("Pioneer" model made by Portec, Inc.) for the preparation of a road base and surface course. Due to the significantly colder winter conditions to which the road was to be subjected, the asphalt specified for the construction was a softer (300-400 Pen) paving asphalt meeting Specification AC 275 of the Alberta Department of Highways and Transport, instead of the 85-100 Pen grade used in the previous example. Typical characteristics of a paving asphalt of this grade are, for example:

Gravity, API, 60° F.-8.2
Specific Gravity, 60° F.-1.0129
Viscosity, poise, 140° F., ASTM D2171-313
Viscosity, cs, 275° F., ASTM D2170-165.9
Flash Point, COC, °F., ASTM D92-525
Softening Point, °F., ASTM D36-91
Pen, 77° F., 100 g, 5 sec. ASTM D5-317
Ductility, 77° F., cm, ASTM D113-68
Soluble in Trichlorethylene, ASTM D2042-99.8%

The aggregate used for the paving job was a screened crushed gravel. The sieve analysis for the aggregate indicated that it substantially all passed through a ⅝" sieve having 15.8 mm openings and only substantially 5% or less passed through a 200 mesh screen having 0.074 mm openings. Marshall test results established that the optimum proportion of standard AC 275 asphalt binder for use with this aggregate was 6%. The Marshall stability for such mix was around 2450 pounds. Using a 40:60 sulfur/asphalt binder, at an optimum proportion of 7% by weight, bearing in mind the greater specific gravity of the binder, the Marshall stability was found to be around 3650 pounds, an increase of about 49%. Using a 50:50 sulfur/asphalt binder at an optimum proportion of 8% by weight, the Marshall stability was found to be around 6650 pounds, an increase of about 170%. The Example was carried out as part of the construction of a section of road to be paved generally with a six-inch asphalt pavement concrete on subgrade (i.e. full depth). A 2000 foot (609 m) section of this road was built using sulfur/asphalt binder for the pavement instead of just asphalt. Part of the test section was built with 40:60 sulfur/asphalt binder at 7% by weight of the mix, and of this section, part was built only four inches (10 cm) thick, part was built six inches (15 cm) thick and part was built eight inches (20 cm) thick. The six- and eight-inch sections were laid in two lifts, the first being four inches (10 cm) and the second two inches (5 cm) or four inches (10 cm) as required. Two other sections of the road were paved with six inch (15 cm) thicknesses laid in two lifts with 50:50 sulfur/asphalt binders, part containing 7% by weight binder in the aggregate mix and part containing the optimum proportion of 8% binder in the aggregate mix. The sulfur/asphalt binder hot mix was produced at a rate of 200 short tons/hour (182,000 kg/hr) with the sulfur/asphalt mixer being connected directly to the spray nozzles of the mixing plant and the feed rates of the binder being manually controlled and adjusted to the aggregate feeder rate by means of the precalibrated metering pumps of the sulfur/asphalt mixer. Temperatures of the binder ingredients, binder mix, and aggregate were regulated and adjusted to the ranges for the corresponding parameters given in the previous example. Hot mix continuously discharged from the mixing plant was transported to the paving site by a fleet of trucks. The binder content of the hot mix was monitored periodically throughout the operation using a Traxler Nuclear Asphalt Content Gauge. The construction of the sections was carried out with conventional road paving equipment. Fifty foot (15 cm) transistion lengths were allowed between adjacent sections of different thicknesses. The remaining length thereof was built using standard procedures to build the required six inch (15 cm) (full depth) hard surfaced road. The test sections using the sulfur/asphalt binder in the aggregate mix were laid and compacted with the same equipment used to lay and compact the rest of the road, and no problems were encountered that were attributable to the substitution of sulfur/asphalt binder for regular asphalt in the mix. The variations in the thicknesses of the road built with the sulfur/asphalt binder were designed to permit assessment of the extent of the superiority of the durability of the various thicknesses of sulfur/asphalt bound concrete, compared to normal asphalt concrete, having the specified proportions of binder of the specified compositions, laid on a substantially uniform subgrade.

EXAMPLE 3

This example illustrates, using the embodiment of the invention described in Example 2, the resurfacing, partly with sulfur/asphalt bound aggregate, of a previously built asphalt concrete pavement highway were ten miles (16 km) required resurfacing on account of disparate deterioration, of which a 5400 foot (1640 m) test section necessitated using two inches (5 cm) of new overlay for half its length and four inches (10 cm) of overlay for the balance of the length. The four-inch overlay was laid in two lifts of two inches (5 cm) each. The sulfur/asphalt and aggregate mixing equipment and the paving and rolling (compacting) equipment used in the previous example was transported about 35 miles (56 km) to a different source of suitable crushed gravel aggregate close to the site of the resurfacing job. Sieve analysis of the aggregate to be used on the job indicated that over 95% passed through a ⅝-inch screen having 15.8 mm openings and only about 2% passed through a 200 mesh screen having 0.074 mm openings. Marshall test data for this aggregate with the same grade of AC 275 grade asphalt used in the proceding example established that the optimum proportion of standard asphalt binder for use with this aggregate was 6% and the Marshall stability for such a mix was around 2100 pounds. Using a 40:60 sulfur/asphalt binder, at an optimum proportion of 7% by weight, the Marshall stability was found to be around 2700 pounds. Using a 50:50 sulfur/asphalt binder at an optimum proportion of 8% by weight, the Marshall stability was found to be around 4100 pounds, an increase of about 95%. With the asphalt/sulfur blending and mixing equipment in conjunction with the aggregate binder mixing equipment as described in the previous example, approximately 1940 tons of sulfur/asphalt bound aggregate containing 7% 40:60 sulfur/asphalt binder was prepared. Temperatures of the binder ingredients, binder mix, and aggregate were regulated and adjusted to the ranges given in Example 1 for the corresponding parameters. Hot mix continuously discharged from the mixing plant was transported to the paving site by a fleet of trucks. As in the preceding example, the binder content of the hot mix was monitored periodically. The hot mix was laid as a two-inch or four-inch overlay, as indicated above, in the single north bound lane of the highway. The adjoining south bound lane was correspondingly overlaid with conventional asphalt aggregate hot mix containing 6% asphalt, prepared in the same continuous aggregate mixing unit, and laid with the same conventional paving equipment and compacted with the same conventional rollers. No significant differences in the laying and rolling of the hot mixes made with asphalt and sulfur/asphalt mix were encountered. The resurfacing operation illustrated the equivalence of performance of asphalt-bound and sulfur/asphalt-bound hot mixes in conventional paving procedures, and the resulting resurfaced road was anticipated to illustrate the potential superior durability of the sulfur/asphalt-bound pavement.

EXAMPLE 4

This example illustrates the laboratory preparation of a 50:50 sulfur/asphalt binder, containing 85–100 Pen asphalt, in a batch colloid mill and the adverse effect of storage on the binder. The particular apparatus used was an Eppenbach mill (model QV-6-B) capable of homogenizing a total of around 15 liters in a batch. A batch of 2000 grams of fluid asphalt heated to 300° F. (149° C.) was poured into the mill and circulated therein with the gap thereof set at the maximum size opening (around 0.075 inch, 1.8 mm). A quantity of 2000 grams of molten sulfur also at 300° F. (149° C.) was gradually added to the mill as circulation of the batch continued. When this addition was completed about 20% of the total sulfur added had combined homogeneously with the asphalt by chemical reaction and/or dissolution, and the remaining 80% dispersed as droplets of liquid sulfur in the asphalt phase. The resulting dispersion was withdrawn from the mill and a sample examined visually under a microscope. The particle size of the molten sulfur droplets dispersed in the asphalt phase was observed to be in a range under substantially 10 microns and averaged substantially 4 to 5 microns. Part of the batch was maintained under light stirring at a temperature of 275°–300° F. (135°–149° C.). A sample of 175 grams of the balance was immediately poured as a binder onto a sample of 2325 grams of screened appropriately-sized heated crushed stone aggregate at around 300° F. (149° C.) in a heated mixing container and mixed with a strong stirrer to coat the binder on the aggregate. When the aggregate had been uniformly coated by the binder the hot mix was compacted in the standard manner for preparation of a specimen for Marshall mix design testing. Additional specimens were similarly immediately prepared and the average Marshall stability of the specimens was determined to be around 4400 pounds. A sample of the part of the batch of binder that had been maintained under light stirring at 275°-300° F. (135°-149° C.) for around one hour was then examined visually under a microscope and the average particle size of the molten sulfur droplets therein was observed to have increased from that of the same material an hour earlier, indicating some agglomeration of the sulfur droplets; many of the droplets had reached a size around 50 microns. Coagulation and settlement of the sulfur could be expected on continued maintenance of the binder in liquid phase and with growth of the liquid sulfur droplets beyond 50 microns. Samples of 175 grams each of this part of the batch were then immediately mixed with heated aggregate as above for the preparation of Marshall test specimens, and the Marshall stability of the specimens determined. The average of the Marshall stabilities was found to be around 4500 pounds, indicating (a) good retention of the physical properties of the binder with sulfur droplets up to 50 microns in diameter and (b) dispersion stability in the liquid phase for up to one hour. Coagulation and settlement of the liquid sulfur droplets was found to be extensive after three hours, rendering the material unsuitable as a binder for asphalt concrete pavement.

Numerous other modifications of the various expedients described can be made without departing from the scope of the invention, which is defined in the following claims.

What is claimed is:

1. Apparatus for preparing a fluid sulfur/asphalt composition comprising (1) pumping means to supply a continuous metered stream of molten sulfur, (2) pumping means to supply a continuous metered stream of fluid asphalt, (3) blending means to blend said streams continuously in proportions of 25 to 60 parts of sulfur per 75 to 40 parts of asphalt and thoroughly mix them to emulsify liquid sulfur, which does not combine homogeneously with the asphalt in the blended stream, as droplets in the size range from 1 to 50 microns, and (4) temperature regulating means to maintain said stream of molten sulfur in the range from 250° to 310° F. (121° to 154° C.), said stream of fluid asphalt in the range from 250° to 350° F. (121° to 177° C.), and said blended stream in the range from 250° to 310° F. (121° to 154° C.).

2. Apparatus as claimed in claim 1, further including discharging means to transfer said blended stream to a point of application thereof within a period of less than 15 minutes from the initial blending of the sulfur and asphalt.

3. Apparatus as claimed in claim 2, in which the discharging means transfers the blended stream to said point of application within less than five minutes.

4. Apparatus for preparing a coated particulate aggregate paving composition, comprising (1) pumping means to supply a continuous metered stream of molten sulfur, (2) pumping means to supply a continuous metered stream of fluid asphalt, (3) blending means to blend said streams continuously in proportions of 25 to 60 parts of sulfur per 75 to 40 parts of asphalt and thoroughly mix them to emulsify liquid sulfur, which does not combine homogeneously with the asphalt in the blended stream, as droplets in the size range from 1 to 50 microns, (4) temperature regulating means to maintain said stream of molten sulfur in the range from 250° to 310° F. (121° to 154° C.), said stream of fluid asphalt in the range from 250° to 350° F. (121° to 177° C.), and said blended stream in the range from 250° to 310° F. (121° to 154° C.), and (5) mixing means, at the discharge of said blending means, for mixing said metered blended stream with a metered quantity of particulate aggregate having a temperature no greater than 310° F. (154° C.) to coat said particles uniformly with the blended stream.

5. Apparatus as claimed in claim 4, in which the temperature regulating means maintains the temperature of the blended stream of sulfur and asphalt at a temperature in the range from 270° to 295° F. (132° to 146° C.).

6. Apparatus as claimed in claim 5 in which the blending means emulsifies the liquid sulfur as droplets in the size range from 1 to 10 microns.

7. Apparatus as claimed in claim 6 in which the blending means blends said streams in proportions of 35 to 50 parts of sulfur per 65 to 50 parts of asphalt.

8. Apparatus as claimed in claim 4 in which said mixing means is a continuous mixing unit connected directly to the discharge of said blending means and continuously coats said blended stream onto a continuous stream of aggregate.

9. Apparatus as claimed in claim 4 in which the mixing means is a batch pug mill into which accumulated batches of the blended stream are metered in proportion to the metered quantity of aggregate, and the aggregate is coated within a period of less than one hour from the time the sulfur is emulsified in the asphalt.

10. Apparatus as claimed in claim 9 in which the period is less than 15 minutes.

11. Apparatus as claimed in claim 9 in which the period is less than 5 minutes.

* * * * *